United States Patent [19]

Waite et al.

[11] Patent Number: 4,529,885

[45] Date of Patent: Jul. 16, 1985

[54] DIRECT CURRENT ELECTROLUMINESCENT DEVICES

[75] Inventors: Michael S. Waite, Tunbridge Wells; Surjit S. Chadha, Southall; Weng Y. Leong, London, all of England

[73] Assignee: The Secretary of State for Defence in Her Britannic Majesty's Government of the United Kingdom of Great Britain and Northern Ireland, Great Britain

[21] Appl. No.: 445,752

[22] Filed: Dec. 1, 1982

[30] Foreign Application Priority Data

Dec. 4, 1981 [GB] United Kingdom ..... 8136678

[51] Int. Cl.[3] ..... H05B 33/10; H05B 33/20

[52] U.S. Cl. ..... 250/484.1; 427/70

[58] Field of Search ..... 250/484.1, 488.1, 487.1, 250/486.1, 458.1; 313/509; 427/70, 69, 66

[56] References Cited

U.S. PATENT DOCUMENTS 2,829,265 4/1958 Harper ..... 250/488.1
3,731,353 5/1973 Vecht ..... 445/6
4,015,166 3/1977 Ohshima et al. ..... 313/503

FOREIGN PATENT DOCUMENTS 138751 12/1978 Japan ..... 427/70
1407098 9/1975 United Kingdom ..... 313/509
1568111 5/1980 United Kingdom .

OTHER PUBLICATIONS

I. F. Chang, J. J. Cuomo and E. S. Yang, "Fabrication of Thin Film Zinc Silicate Phosphor", *IBM Technical Disclosure Bulletin*, vol. 22, No. 6, (Nov. 1979), pp. 2563–2564.

*Primary Examiner*—Alfred E. Smith
*Assistant Examiner*—Constantine Hannaher
*Attorney, Agent, or Firm*—Cushman, Darby & Cushman

[57] ABSTRACT

A direct current electroluminescent device having a phosphor layer and coating electrodes, at least one of which is translucent, which has interposed between the phosphor layer and at least one of said electrodes a thin non-planar layer of an electrically non-conducting substance. The non-planar layer may have a cross section of undulating outline or may be a discontinuous layer, e.g. in the form of closely spaced dots. Preferably the non-planar layer is translucent and is arranged between the phosphor layer and a translucent electrode. Suitable materials for the non-planar layer include silicon monoxide, silicon dioxide, germanium dioxide, magnesium fluoride, cadmium fluoride, yttrium fluoride, yttrium oxide, zinc sulphide, copper sulphide.

16 Claims, 4 Drawing Figures

DIRECT CURRENT ELECTROLUMINESCENT DEVICES

This invention relates to direct current electroluminescent devices in which the active substance is a solid eg a powder phosphor.

In UK Patent Specification No. 1300548 it is described how the performance of such devices may be enhanced by the process of forming; which is a preliminary passage of direct electric current through the device before it is taken into regular service. The power needed to form an electroluminescent device has hitherto been of the order of 1 $wcm^{-2}$. The present invention permits the power to be reduced to a fraction as little as $10^{-4}$. This reduction in forming power may be of considerable importance where large electroluminescent panels are being made in quantity.

According to the invention a direct current electroluminescent device (DCEL device) having a phosphor layer and coacting electrodes has interposed between the phosphor layer and at least one of said electrodes a thin non-planar layer of an electrically non-conducting substance.

The non-planar layer may have a cross section of undulating outline, or it may be a discontinuous layer, for example in the form of closely spaced dots of said non-conducting substance.

The maximum thickness of the non-planar layer is of the order of one micrometer and the minimum thickness of the order of 50 millimicrometer.

Preferably the non-planar layer is arranged between the phosphor layer and a translucent electrode.

The non-planar layer may consist, for example, of at least one of silicon monoxide, silicon dioxide, germanium dioxide, magnesium fluoride, cadmium fluoride, yttrium fluoride, yttrium oxide, zinc sulphide, copper sulphide.

The invention extends to a method of producing an electroluminescent device having a non-planar layer of an electrically non-conducting substance, which includes evaporating particles of a selected non-conducting substance and directing the evaporated particles onto a substrate which is part of the device to be produced, while controlling the distribution of said particles on the substrate.

An undulating layer may be produced on the substrate by directing the evaporated particles onto the substrate at an angle thereto differing substantially from a right angle. Preferably the evaporated particles are directed onto the substrate at an angle in the range from about 10° to about 40° from a normal to the substrate where the particles are deposited.

A discontinuous layer of closely spaced dots of non-conducting substance may be produced on the substrate by directing the evaporated particles onto the substrate through a perforate mask, which may, for example, be a mesh of metal wire or plastics filament.

Figure 1:
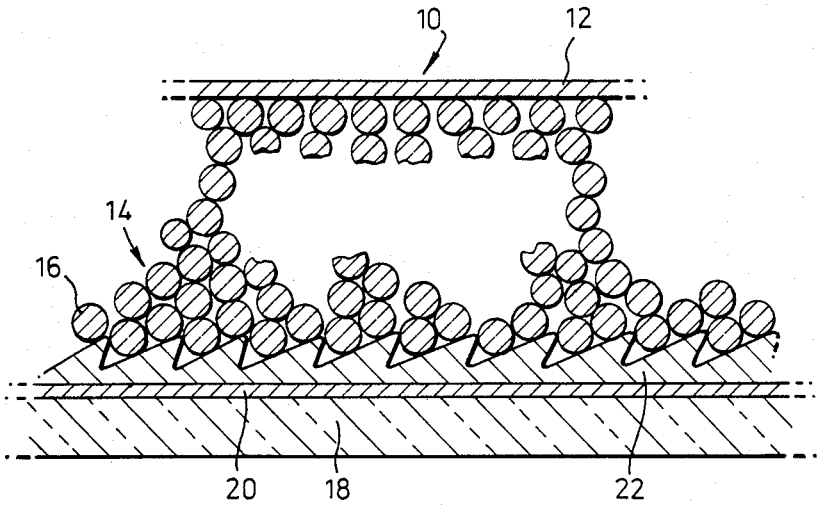
Figure 2:
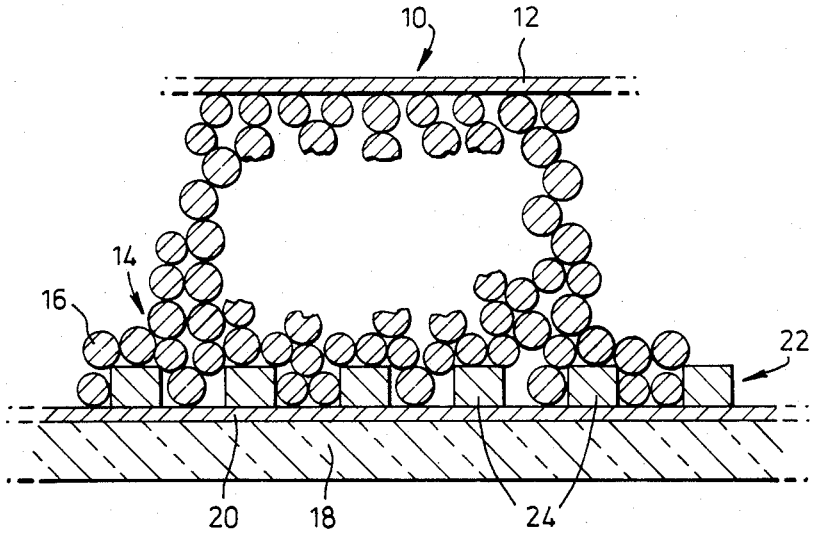
Figure 3:
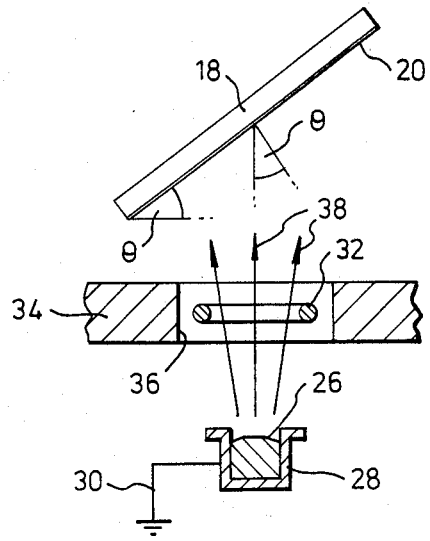
Figure 4:
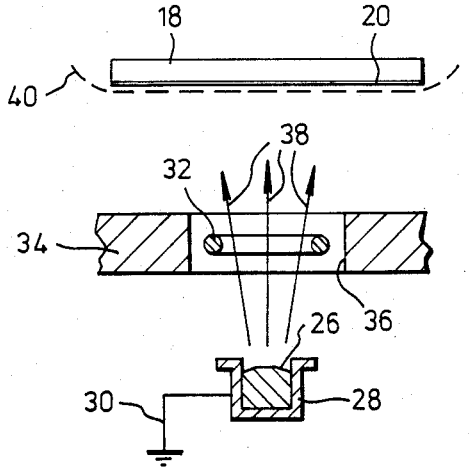

The invention will be further described with reference to the accompanying drawings in which:

FIG. 1 is a section through a DCEL device having a non-planar layer of undulating cross section FIG. 2 is a section through a DCEL device having a non-planar layer in the form of dots of electrically non-conducting substance FIG. 3 illustrates diagrammatically the production of a non-planar layer of undulating cross section FIG. 4 illustrates diagrammatically the production of a non-planar layer in the form of dots.

Referring to FIG. 1, a section is shown through part of a DCEL device indicated generally by 10. The device has two electrodes. One of the electrodes is of metal 12, which may be the base of the device for mounting and fixing. In contact with the electrode 12 is a phosphor layer 14, comprising largely particles, for example 16, of phosphor material. The phosphor material is typically zinc sulphide:manganese:copper, but may be of a different composition. The device 10 also comprises a sheet of glass 18. On 18, to constitute a second electrode, is arranged a conducting layer 20 which is transparent. The layer 20 may be for example of tin oxide or indium tin oxide. On the conducting layer 20 as substrate is arranged a non-planar layer 22 of electrically non-conducting or dielectric substance. The layer 22 is shown to have a cross-section the outline of which is undulating. The phosphor layer 14 may be laid down on the non-planar layer 22, and the electrode 12 then applied; or the phosphor layer 14 may be laid down on the electrode 12 and be held in contact with the non-planar layer 22 by external force in the assembly of the DCEL device.

Referring to FIG. 2, reference numerals which are the same as in FIG. 1 indicate the same integers. However, in FIG. 2 the non-planar layer 22 is made up of an array of closely spaced dots 24 of dielectric substance.

Suitable dielectric substances include:

a. silicon monoxide,
b. silicon dioxide, germanium dioxide,
c. magnesium, cadmium and yttrium fluorides,
d. yttrium oxide,
e. zinc sulphide, copper sulphide.

Of these substances silicon monoxide in any substantial thickness is opaque to visible light. It is therefore used as a very thin continuous non-planar layer having an average thickness of not more than about 500 millimicrometer; or in the form of spaced dots of dielectric. The other dielectric substances mentioned above are all transparent to visible light in thicknesses up to about 1 micrometer at least.

FIG. 3 illustrates the method and apparatus for laying down a non-planar layer of undulating cross-section. The process is conducted in evaporation apparatus (not illustrated) of conventional kind having the usual arrangements for providing a high vacuum (ie low pressure). The chosen dielectric material 26 to be evaporated is arranged in a carbon crucible 28 which is connected to earth at 30. Close to the crucible is arranged a ring shaped filament 32, coplanar with a focussing electrode 34 which has in it an aperture 36 in which the ring shaped filament is situated. On the opposite side of filament 32 from the crucible 28 is arranged the substrate 20, that is the conducting layer on the glass sheet 18.

The filament 32 is made of a material, for example molybdenum or tungsten, which can be heated to produce thermionic emission therefrom. In this embodiment a heating current of about 30 ampere is employed. The focussing electrode 34 is held at a voltage of about −300 volt relative to earth. Electrons from the filament 32 are driven to the crucible 28 and heat the contents 26 to evaporation by bombardment. A suitable voltage difference between filament and crucible is in the range from about 2000 volt to 3000 volt. When the dielectric substance 26 is evaporated from the crucible the evaporated particles travel in the direction of the arrows 38 towards the substrate 20 which is arranged at an angle oblique to the average direction of the evaporated particles. The angle $\theta$ between said average direction and the normal to the substrate where the particles are deposited is preferably in the range from about 10° to about 40°. This produces on the substrate 20 a non-planar layer 22 of undulating cross section, as illustrated in FIG. 1. The thickness attained by the non-planar layer may be controlled by the quantity of electrically non-conducting substance initially placed in the crucible 28 for evaporation therefrom. The maximum thickness is typically not more than about one micrometer, while the minimum thickness is of the order of 50 millimicrometer.

FIG. 4 illustrates the method and apparatus for laying down a non-planar layer which is discontinuous, in the form of an array of closely spaced dots of an electrically non-conducting substance on a substrate. The crucible 28, filament 32 and focussing electrode 34 are arranged as already explained with reference to FIG. 3. In this instance the substrate 20 is arranged so that its plane is normal to the average direction of evaporated particles indicated by the arrows 38. Further, there is arranged in contact with the substrate, or very close thereto, a perforate mask 40, between the substrate and the source of evaporated particles. The perforations in the mask are arranged to have such a dimension and spacing that passage of the evaporated particles through the perforations builds up on the substrate 20 an array of dots (22 in FIG. 2) of the required size and spacing. A suitable mask may be prepared from a woven mesh which may be, for example, of metal, such as stainless steel; or of plastics material such as nylon monofilament. A suitable size for holes in the mask 40, (or the mesh size) is in the range from about 10 to 50 micrometer. The mask may be positioned in relation to the substrate 20 at a distance from zero up to about 5 millimeter.

Tests have been conducted with zinc sulphide:manganese:copper (ZnS:Mn:Cu) DCEL cells with a non-planar layer 22, the electrically non-conducting substance being in this case silicon oxide (SiO). A range of angles has been used at which to evaporate the layer onto the substrate 20, the thickness of the layer being not more than about 100 millimicrometer. The power required to form a DCEL cell of conventional form is of the order of 1 watt $cm^{-2}$. With an evaporated film of SiO the forming power is reduced as the angle for evaporation ($\theta$ in FIG. 3) is increased away from the normal, from about 0.66 watt $cm^{-2}$ at zero degrees to about 0.00005 watt $cm^{-2}$ at 40 degrees.

A non-planar layer 22 in the form of an array of dots, when the electrically non-conducting substance is SiO, has advantages in contrast enhancement in a DCEL cell. In an example in which the said substance was evaporated onto a substrate 20 through a nylon mesh 40, having 50 micrometer perforations, and using a Zns:Mn:Cu phosphor the contrast enhancement was found to be in a ratio of the order of 1.25 to 1.

We claim:

1. A direct currect electroluminescent device comprising (a) a phosphor layer, (b) coacting electrodes, at least one of said electrodes being planar and translucent, and (c) a thin non-planar layer of an electrically non-conducting substance interposed between said phosphor layer and said at least one electrode.

2. A device according to claim 1 in which the non-planar layer has a cross section of undulating outline.

3. A device according to claim 1 in which the non-planar layer is a discontinuous layer.

4. A device according to claim 3 in which the non-planar layer is in the form of closely spaced dots of said non-conducting substance.

5. A device according to claim 1 in which the maximum thickness of the non-planar layer is not more than about one micrometer.

6. A device according to claim 2 in which the minimum thickness of the non-planar layer is about fifty nanometers.

7. A device according to claim 1 in which the non-planar layer is translucent and is arranged between the phosphor layer and an electrode which is translucent.

8. A device according to claim 1 in which the non-planar layer consists of at least one of silicon monoxide, silicon dioxide, germanium dioxide, magnesium fluoride, cadmium fluoride, yttrium fluoride, yttrium oxide, zinc sulphide, copper sulphide.

9. A method of producing an electroluminescent device having a non-planar layer of an electrically non-conducting substance which includes the steps of evaporating particles of a selected non-conducting substance and directing the evaporated particles onto a substrate which is part of the device to be produced, while controlling the distribution of said particles on the substrate.

10. A method according to claim 9 in which an undulating layer is produced on the substrate by directing the evaporated particles onto the substrate at an angle thereto differing substantially from a right angle.

11. A method according to claim 10 in which the evaporated particles are directed onto the substrate at an angle in the range from about 10° to about 40° from a normal to the substrate where the particles are deposited.

12. A method according to claim 9 in which a discontinuous layer of closely spaced dots is produced on the substrate by directing the evaporated particles onto the substrate through a perforate mask.

13. A direct current electroluminescent device comprising (a) a first planar and translucent electrode, (b) a thin non-planar layer of an electrically non-conducting substance formed on said first electrode, (c) a second electrode spaced from said non-planar layer, and (d) a phosphor layer disposed between and in contact with said non-planar layer and said second electrode.

14. A device as in claim 13 wherein said non-planar layer has an undulating cross-sectional outline.

15. A device as in claim 13 wherein said non-planar layer is a discontinuous layer.

16. A device as in claim 15 wherein said non-planar layer includes a plurality of closely spaced dots of said non-conducting substance.

* * * * *